US006162163A

United States Patent [19]

Karlsson

[11] Patent Number: 6,162,163

[45] Date of Patent: Dec. 19, 2000

[54] CENTRIFUGAL SEPARATOR HAVING A CHAMBER WITH A DEFORMABLE WALL PORTION

[75] Inventor: Per Gunnar Karlsson, Hägersten, Sweden

[73] Assignee: Alfa Laval AB, Tumba, Sweden

[21] Appl. No.: 09/268,435

[22] Filed: Mar. 12, 1999

[51] Int. Cl.[7] ..... B04B 1/08; B04B 7/08

[52] U.S. Cl. ..... 494/82; 494/70

[58] Field of Search ..... 494/56, 82, 67–73, 494/85

[56] References Cited

U.S. PATENT DOCUMENTS

| | | | |
|---|---|---|---|
| 3,823,869 | 7/1974 | Loison . | |
| 4,193,537 | 3/1980 | Bodelson et al. . | |
| 4,961,723 | 10/1990 | Bruning et al. | 494/70 |
| 5,186,708 | 2/1993 | Stroucken et al. | 494/70 |
| 5,779,619 | 7/1998 | Borgstrom et al. | 494/56 |
| 5,921,909 | 7/1999 | Gustafsson | 494/70 |

*Primary Examiner*—Charles E. Cooley
*Attorney, Agent, or Firm*—Fish & Richardson P.C.

[57] ABSTRACT

A centrifugal separator comprises a centrifuge rotor (1), which has a wall (10) defining an interior of the rotor (1) and which during operation of the centrifugal separator is rotatable about a rotational axis (y) with respect to a stationary pipe member (2) comprising at least one passage for the transport of material. The pipe member (2) is provided to extend into the interior of the centrifuge rotor through an aperture of the rotor (1). A product separated during operation is collected in a chamber (9) provided in the proximity of said aperture and partly defined by an end wall portion (11) extending around said aperture and the pipe member (2) in such a manner that a clearance gap is formed between a radially inner edge of the end wall portion (11) and the pipe member (2). The end wall portion (11) is arranged to be deformable in the case that the pipe member contacts the end wall portion during the operation of the separator.

13 Claims, 2 Drawing Sheets

CENTRIFUGAL SEPARATOR HAVING A CHAMBER WITH A DEFORMABLE WALL PORTION

THE BACKGROUND OF THE INVENTION AND PRIOR ART

The present invention refers to a centrifugal separator comprising a centrifuge rotor, which has a wall defining an interior of the rotor and which during operation of the centrifugal separator is rotatable about a rotational axis with respect to a stationary pipe member comprising at least one passage for the transport of material, the stationary pipe member being provided to extend into the interior of the centrifuge rotor through an aperture of the rotor, and a chamber provided in the proximity of said aperture to collect a product separated during operation, the chamber being partly defined by an end wall portion, extending around the aperture and the pipe member in such a manner that a clearance gap is formed between a radially inner edge of the end wall portion and the pipe member.

The separated product collected in the chamber forms a rotating liquid body having a radially inwardly facing free liquid surface located radially outside said edge.

During operation of such a centrifugal separator, the centrifuge rotor may oscillate. Such oscillating may arise when the rotor reaches or passes a critical number of revolutions or may be the result of small imbalances of the centrifuge rotor due to, for instance, an uneven distribution of the material within the rotor. Because of such oscillating, it may happen that said edge of the end wall portion of the rotor contacts or hits the outer peripheral surface of the pipe member. Such a contact between said edge of the end wall portion and the pipe member may have severe consequences to the operation of the centrifugal separator. Due to the high rotational speed of the centrifuge rotor, the high kinetic energy may deform the end wall portion and the pipe member and damage the rotor, and in a worse case cause a complete breakdown of the operation of the centrifugal separator. Furthermore, the forces developed by such a hit have a negative impact on the interior elements of the rotor.

In order to avoid such consequences, it is known to increase the dimensions of said aperture, and thus the size of the clearance gap between said edge of the end wall portion and the pipe member. However, an increase of the size of the clearance gap means that the position of the surface level of the liquid collected in the chamber is displaced radially outwardly, which influences negatively the function of a paring disc connected to the pipe member, and which also might force the inlet surface level of the liquid in the interior of the rotor radially outwardly. In addition, such a displacement of the surface level in the collecting chamber increases the effect consumption. Furthermore, a large clearance gap increases the risk that the separated product is flowing out of the centrifuge rotor in an uncontrolled manner over the radial inner edge of the end wall portion.

SUMMARY OF THE INVENTION

The object of the present invention is to reduce the risk of a break-down of the centrifugal separator as a result of the high forces due to the contact between the centrifuge rotor and the pipe member, while maintaining a small radius of the surface level in said collecting chamber.

This object is obtained by a centrifugal separator in which said end wall portion is arranged to be deformable in the case that the pipe member contacts said end wall portion during the operation of the centrifugal separator. By such a deformable, and preferably replaceable end wall portion, or flange, it is possible to avoid the above severe consequences of a contact between the centrifuge rotor and the pipe member, since the end wall portion designed in accordance with the present invention is easily deformed, which means that no great forces may be developed as a result of such a contact. Furthermore, by such an end wall portion the clearance gap may be minimized and consequently the radius of the surface level of the liquid in the collecting chamber may be short. Such a deformation may advantageously involve an outwardly directed bending movement of the end wall portion with respect to said rotational axis.

According to an embodiment of the present invention, the end wall portion, seen in a cross-section including said rotational axis, extends in a horizontal direction and a vertical direction with respect to said rotational axis. By such a vertical extension of the end wall portion, it is ensured that the end wall portion is easily deformable in an outward direction. Thereby, the end wall portion may comprise a first wall part and a second wall part which, seen in said cross-section, form an angle to each other. Preferably, the first wall part is essentially vertical and the second wall part is essentially horizontal. Such a vertical part is significantly weak, with respect to any contact due to oscillating movements of the centrifuge rotor and therefore ensures the deformability of the end wall portion.

According to a further embodiment of the present invention, the end wall portion comprises a sheet material having a relatively thin thickness compared to the thickness of an adjacent wall portion of the centrifuge rotor. Such a thin end wall portion may be easily manufactured, for instance by machining the material of the wall portion by milling, turning or any similar machining method.

According to another embodiment of the present invention, the end wall portion is made of a material having a relatively low strength compared to the strength of the material of an adjacent wall portion of the centrifuge rotor. For instance, it may be possible to manufacture the end wall portion of a plastic material having a significantly lower strength than the steel material of the wall of the centrifuge rotor.

According to a further embodiment of the present invention, the end wall portion comprises locally weakened portions, which may comprise grooves or depressions, for instance radially extending grooves.

According to a further embodiment of the present invention, the end wall portion is arranged to be plastically deformable in the case that the pipe member contacts the end wall portion during the operation of the centrifugal separator. By such a plastic deformation, it is ensured that the operation of the centrifugal separator may continue although the volume of the collecting chamber is reduced. Alternatively, the end wall portion is arranged to be elastically deformable in the case that the pipe member contacts the end wall portion during the operation of the centrifugal separator.

According to a further embodiment of the present invention, the end wall portion forms an integrated part of the wall defining the centrifuge rotor. Such a construction is advantageous, since it may be produced in an easy manner, it does not increase the weight of the centrifuge rotor and it requires no additional space.

According to another embodiment of the invention, said end wall portion forms a separate part or flange being mountable to the wall defining the centrifuge rotor by attachment means. Such a releasably mounted end wall portion or flange may in an easy manner be replaced after it has been deformed.

BRIEF DESCRIPTION OF THE DRAWINGS

The present invention is now to be explained more closely by means of different embodiments and with reference to the drawings attached hereto.

DETAILED DESCRIPTION OF DIFFERENT EMBODIMENTS OF THE INVENTION

Figure 1:
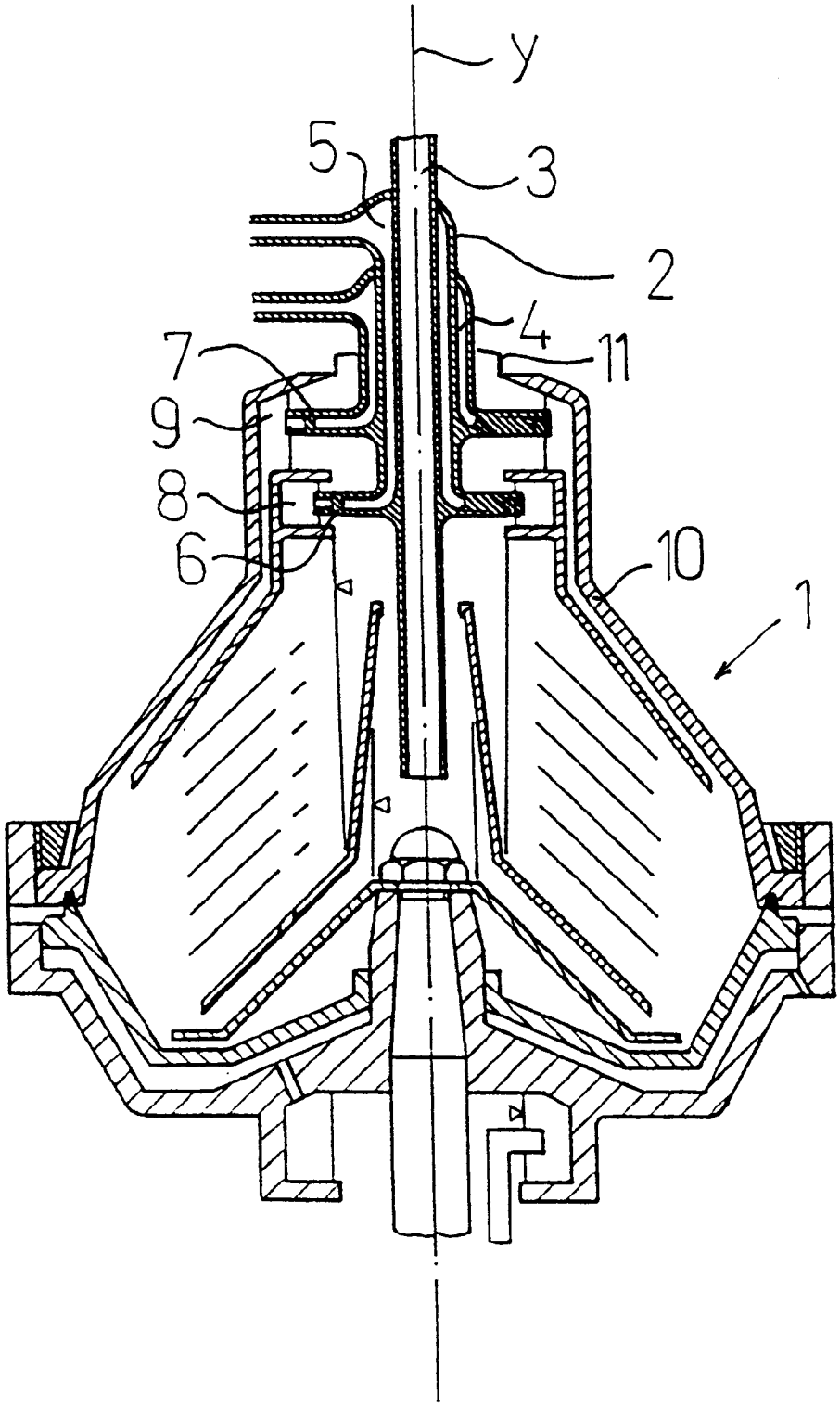
FIG. 1 discloses schematically a sectional view of a centrifuge rotor of a centrifugal separator according to the present invention.

FIG. 1 discloses schematically a centrifuge rotor intended to form a part of a centrifugal separator. A pipe member 2 of the centrifugal separator extends into the interior of the centrifuge rotor 1 through an aperture of the centrifuge rotor 1. The pipe member 2 comprises, in the embodiment disclosed, an inlet passage 3 for the supply of material to be separated to the centrifuge rotor 1 and two outlet passages 4, 5 for the discharge of a respective separated product from the centrifuge rotor 1. Each of the discharge outlet passages 4, 5 is connected to a paring disc 6 and 7, respectively, which extend essentially radially into a lower collecting chamber 8 and an upper collecting chamber 9, respectively, in which the respective separated product is collected during the operation of the centrifugal separator and forms a rotating liquid body having a radially inwardly facing free liquid surface.

In the embodiment disclosed, the pipe member 2 is stationary and the centrifuge rotor 1 is rotatable at a high speed about the pipe member 2 and an rotational axis y by means of a drive motor (not disclosed).

The centrifuge rotor 1 has a wall 10 defining an interior of the centrifuge rotor 1 and having an upper end wall portion 11 extending around said aperture and the pipe member 2 in such a manner that a clearance gap is formed between a radially inner edge of the end wall portion 11 and the pipe member 2. The upper collecting chamber 9 is provided in the proximity of said aperture and is partly defined by the end wall portion 11.

Figure 2:
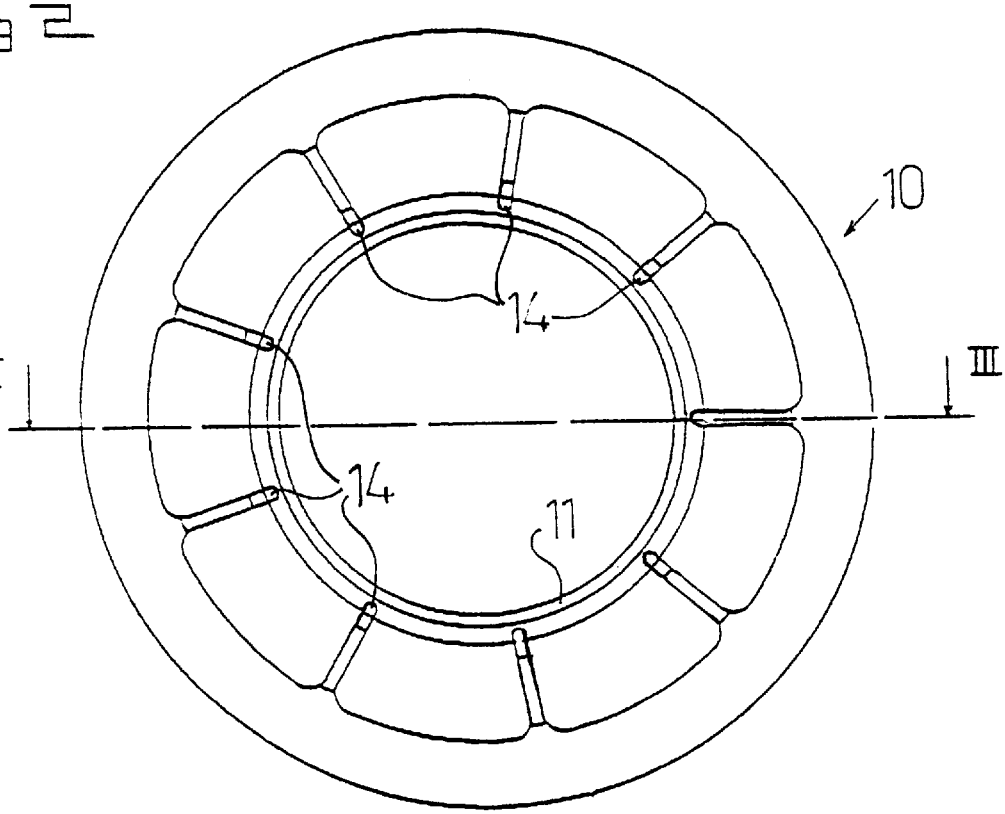
FIG. 2 discloses a view from beneath of an upper part of the centrifuge rotor according to an embodiment of the present invention.
Figure 3:
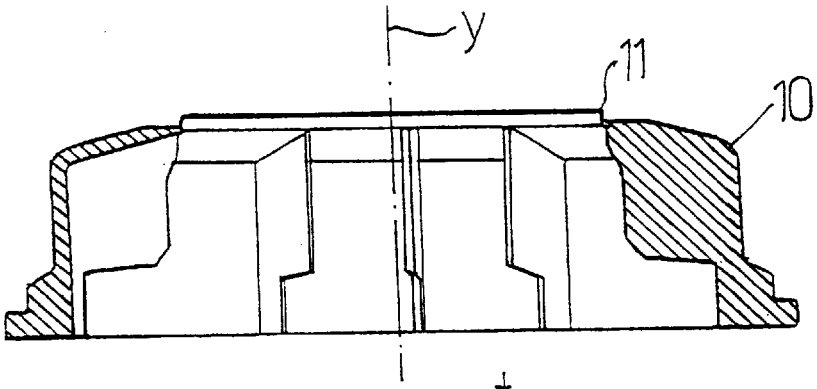
FIG. 3 discloses a sectional view along the lines III—III in FIG. 2.
Figure 4:
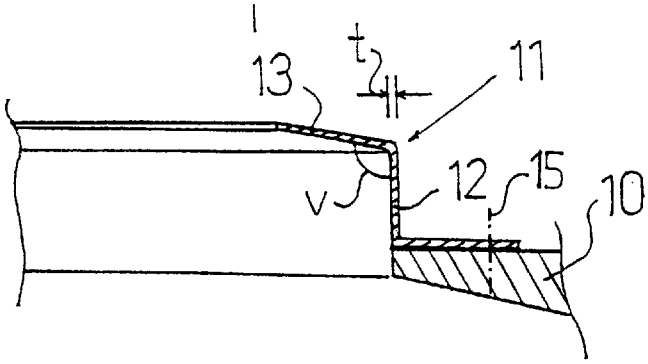
FIG. 4 discloses an enlarged part of the section disclosed in FIG. 3.

The wall portion 11 is more closely disclosed in FIG. 2–4. As appears from FIG. 3 and 4, the end wall portion 11 extends in a horizontal direction and a vertical direction with respect to the rotational axis y. Preferably, the first wall part 12 forms an angle v to the second wall part 13, seen in the cross-section of FIG. 4. In particular, the end wall portion 11 comprises a first wall part 12 being essentially vertical and a second wall part 13 being essentially horizontal. It is to be noted that the precise extension of the end wall portion 11 may vary within the scope of the present invention, for instance, the end wall portion may comprise an essentially straight wall part extending obliquely radially inwardly, seen in the section disclosed. A curved end wall portion is also possible.

In the embodiment disclosed, the end wall portion 11 comprises a sheet material having a relatively thin thickness t in comparison to the thickness of the wall portion 10. Preferably, the thickness t is less than 2 mm.

According to the present invention, the end wall portion 11 is arranged to be plastically deformed in the case that the centrifuge rotor 1 is subjected to oscillating movements of such a magnitude that the end wall portion 11 contacts or hits the stationary pipe member 2 during the operation of the centrifugal separator. As a result of such a contact the end wall portion 11 is bent radially outwardly from the rotational axis y. In the embodiment disclosed, in particular the vertical wall part 12 is weak and thus permits said outwardly directed deformation of the end wall portion 11. As appears from FIG. 1, the clearance gap between the radially inner edge of the end wall portion 11 and the pipe member 2 may be minimized, since any incidental contact between the end wall portion 11 and the pipe member 2 can not lead to any severe damages on the centrifugal separator.

In the embodiment disclosed, the weakness of the end wall portion 11 is achieved by means of the shape of the end wall portion 11 and the thin thickness t of the sheet material of the end wall portion 11. Such a weakness may also be achieved by the use of a material of a relatively low strength compared to the strength of the steel material of the wall 10 of the centrifuge rotor 1. For instance, such material may be a weaker metal, such as copper or aluminum, or any other material, such as plastic material. A further way of achieving such a weakness, is to provide the end wall portion with locally weakened portions or depressions, for instance radially extending grooves, schematically indicated at 14 in FIG. 2.

The end wall portion 11 disclosed forms an integrated part of the wall 10 defining the centrifuge rotor 1. Thereby, the end wall portion 11 is produced by machining the upper part of the wall 10, for instance by turning or milling. However, it is also possible to manufacture the end wall portion 11 as a separate part or flange being mountable to the wall 10 by any suitable attachment means 15, for instance bolts. (see FIG. 4) The end wall portion 11 may also be welded or brazed to the wall 10.

The present invention is not limited to the embodiments described above but may be varied and modified within the scope of the following claims. For instance, the end wall portion 11 may be manufactured in such a material that it is elastically deformable in case the stationary pipe member 2 contacts the end wall portion 11 during the operation of the centrifugal separator. By such an elastic material the end wall portion 11 may, at least partly, return to its original shape after such a contact. Furthermore, the stationary pipe member 2 may also be designed to enclose merely an inlet passage or merely an outlet passage.

What is claimed is:

1. A centrifugal separator comprising a centrifuge rotor (1), which has a wall (10) defining an interior of the rotor (1) and which during operation of the centrifugal separator is rotatable about a rotational axis (y) with respect to a stationary pipe member (2) comprising at least one passage (3) for the transport of material, the stationary pipe member (2) being provided to extend into the interior of the centrifuge rotor (1) through an aperture of the rotor (1), and a central chamber (9) provided in the proximity of the aperture to collect a product separated during operation, the central chamber (9) being partly defined by an end wall portion (11) said end wall portion (11) forming a detachable flange extending beyond the wall (10) and being relatively weaker compared to the wall (10), said end wall portion (11) extending around and forming the aperture and extending around the pipe member (2) in such a manner that a clearance gap is formed between a radially inner edge of the end wall portion (11) and the pipe member (2), wherein said end wall portion (11) is arranged to be deformable in the case that the pipe member (2) contacts said end wall portion (11) during the operation of the centrifugal separator.

2. A centrifugal separator according to claim 1, wherein the end wall portion (11) is arranged to be deformable by being bendable outwardly with respect to said rotational axis (y).

3. A centrifugal separator according to claim 2, wherein said end wall portion (11), seen in a cross-section including said rotational axis (y), extends in a horizontal direction and a vertical direction with respect to said rotational axis (y).

4. A centrifugal separator according to claim 3, wherein said end wall portion (11) comprises a first wall part (12) and a second wall part (13) which, seen in said cross-section, form an angle (v) to each other.

5. A centrifugal separator according to claim 4, wherein said first wall part (12) is essentially vertical and said second wall part (13) essentially horizontal.

6. A centrifugal separator according to claim 1, wherein said end wall portion (11) comprises a sheet material having a relatively thin thickness (t) compared to the thickness of an adjacent portion of wall (10) of the centrifuge rotor (1).

7. A centrifugal separator according to claim 1, wherein said end wall portion (11) is made of a material having a relatively low strength compared to the strength of the material of an adjacent portion of wall (10) of the centrifuge rotor (1).

8. A centrifugal separator according to claim 1, wherein said end wall portion (11) comprises locally weakened portions (14).

9. A centrifugal separator according to claim 8, wherein said locally weakened portions comprises grooves (14).

10. A centrifugal separator according to claim 1, wherein said end wall portion (11) is arranged to be plastically deformable in the case that the pipe member (2) contacts said end wall portion (11) during the operation of the centrifugal separator.

11. A centrifugal separator according to claim 1, wherein said end wall portion (11) is arranged to be elastically deformable in the case that the pipe member (2) contacts said end wall portion (11) during the operation of the centrifugal separator.

12. A centrifugal separator according to claim 1, wherein said end wall portion (11) forms an integrated part of the wall (10).

13. A centrifugal separator according to claim 1, wherein said end wall portion (11) is mountable to the wall (10) by attachment means.

* * * * *